United States Patent [19]

Meyer et al.

[11] Patent Number: 4,976,098

[45] Date of Patent: Dec. 11, 1990

[54] METHOD AND APPARATUS FOR DISSIPATING HEAT FROM A TEXTILE MACHINE

[75] Inventors: Urs Meyer, Niederglatt; Andre Lattion, Seuzach, both of Switzerland

[73] Assignee: Rieter Machine Works, Ltd., Winterthur, Switzerland

[21] Appl. No.: 304,799

[22] Filed: Jan. 31, 1989

[30] Foreign Application Priority Data

Jan. 30, 1988 [CH] Switzerland ..... 00313/88

[51] Int. Cl.[5] ..... D01H 13/28; F24F 7/00

[52] U.S. Cl. ..... 57/308; 57/304; 165/47; 165/54

[58] Field of Search ..... 57/304, 308; 165/47, 165/54, 104.14; 98/115.1

[56] References Cited

U.S. PATENT DOCUMENTS

| | | | |
|---|---|---|---|
| 2,160,980 | 6/1939 | Morton | 165/54 |
| 2,716,859 | 9/1955 | Compton | 57/100 |
| 3,086,348 | 4/1963 | Fowler et al. | 57/308 X |
| 3,963,416 | 6/1976 | Mach | 98/115.1 X |
| 4,350,007 | 9/1982 | Gasser et al. | 57/308 X |
| 4,693,069 | 9/1987 | Imhof et al. | 57/308 X |
| 4,699,208 | 10/1987 | Wolf et al. | 165/47 |
| 4,736,580 | 4/1988 | Wolf | 57/100 |

FOREIGN PATENT DOCUMENTS

| | | |
|---|---|---|
| 2454230 | 5/1975 | Fed. Rep. of Germany . |
| 3533033 | 4/1987 | Fed. Rep. of Germany . |

*Primary Examiner*—Stuart S. Levy
*Assistant Examiner*—Steven M. duBois
*Attorney, Agent, or Firm*—Kenyon & Kenyon

[57] ABSTRACT

The textile machine has a cooling fluid circuit for dissipating heat from the heat-emitting parts of the textile machine. The cooling circuit has a coil disposed within an air duct of the textile machine from which the air can be blown to the outside. A longitudinally extending fly suction duct may also be used for cooling the cooling fluid of a cooling circuit used to cool the motor and convertor of the textile machine. The fly duct thus serves to remove heat as well as fly from the machine.

23 Claims, 7 Drawing Sheets

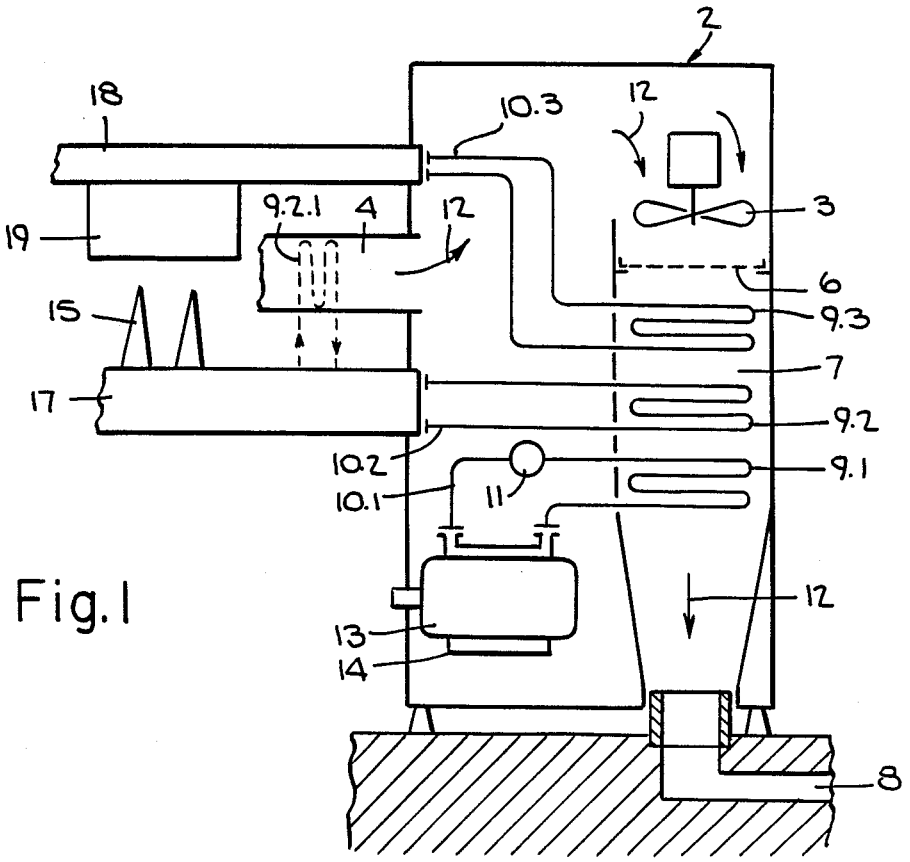
Fig. 1
Fig. 2
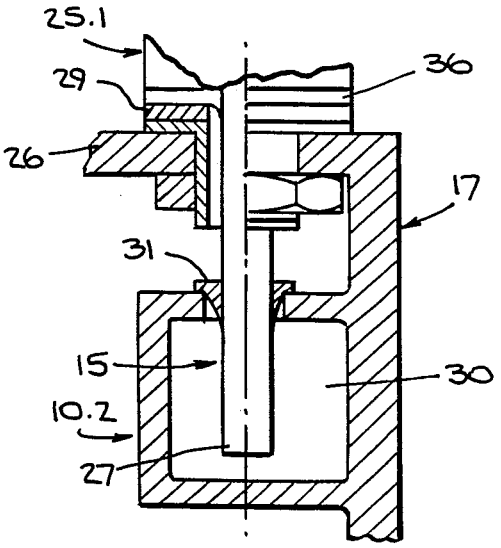

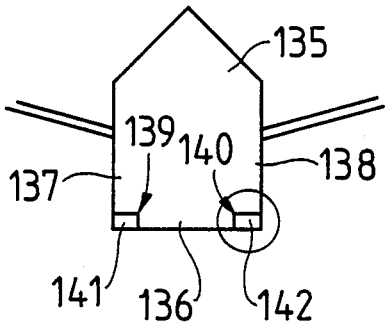
Fig. 11
Fig. 12
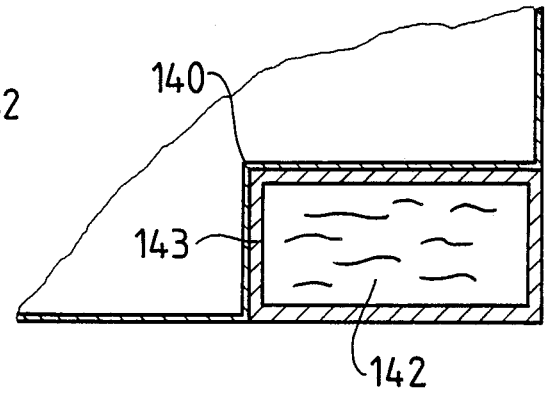
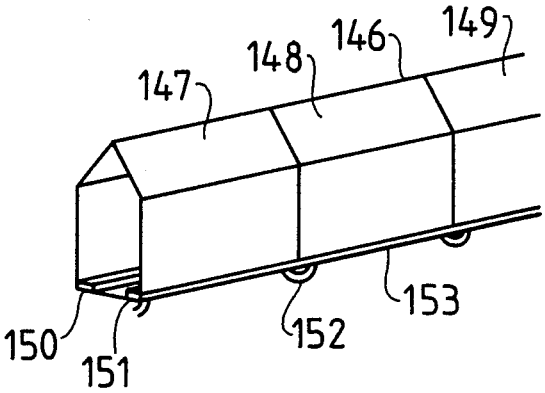
Fig. 13
Fig. 14
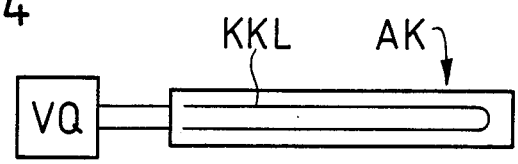

Fig. 15
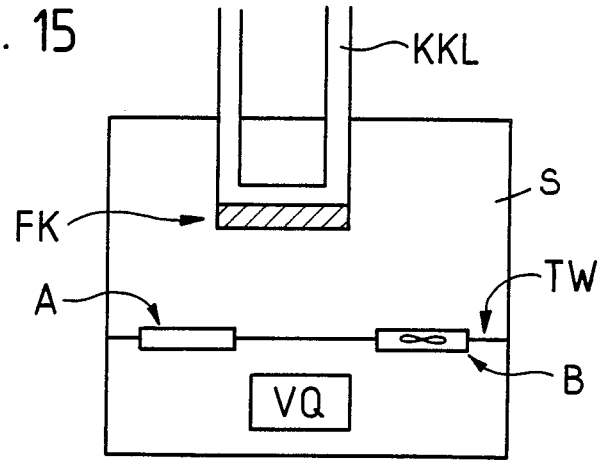
Fig. 16
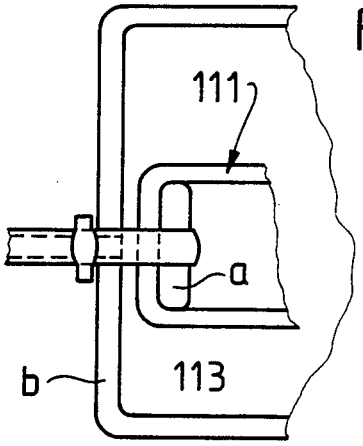
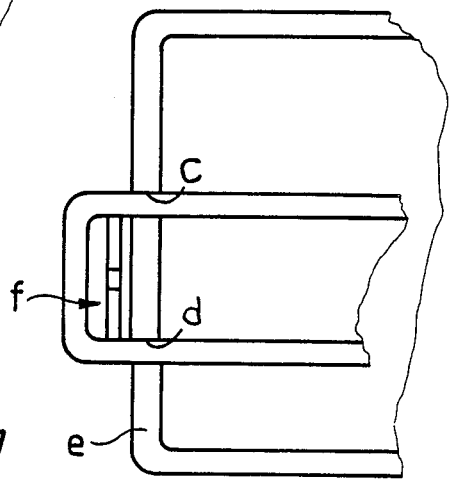
Fig. 17

METHOD AND APPARATUS FOR DISSIPATING HEAT FROM A TEXTILE MACHINE

This invention relates to a method and apparatus for dissipating heat from a textile machine. More particularly, this invention relates to a method and apparatus for dissipating heat from a room containing a plurality of textile machines.

As is known, textile plants have been constructed in various manners in order to condition the ambient air of the plant, particularly the air about a textile machine. In addition, various techniques have been employed for the cooling of the various components of the textile machines. For example, U.S. Pat. No. 2,716,859 describes a heat exchanger for the cooling of a motor at the end of a spinning frame. German Patent No. 3533030 describes a cooling arrangement for a yarn bobbin. German O.S. No. 2454230 describes an arrangement for drawing air through a motor housing of a textile machine.

in the "Rieter-Ringspinnprospekt 1193d-674", the drive motor for all the spindles is accommodated in a machine end head with the motor being cooled with filtered suction air. Although the motor is protected from fly in this case, the dissipated heat passes into the spinning shop so that an air-conditioning plant must supply more cooling power in order to reduce the maximum permissible room temperature.

It is also known from Japanese published application No. 60-143781, filed in 1984, to relieve the load on the air-conditioning system of a textile plant by guiding the hot outgoing air to atmosphere via floor ducts. However, this method can be used only if the heat-emitting machine parts are located in the machine head. In the case of a sectional drive, for example, spindles are driven in sections by motors disposed over the length of the ring spinning machine and are provided with at least one fan o the rotor shaft. The section motors are cooled by fly-saturated air and their waste heat contributes to the increase in the temperature of the spinning shop. In the case of the individual spindle drive, although mechanical and air friction from heat-generating drive belts, reversing pulleys and the central drive shaft with the drive pulleys are eliminated, the heat due to the energy losses from the individual motors also passes into the spinning shop.

It has also been known to discharge the energy loss heat in a textile machine by means of air flowing to a suction duct, for example, as described in German No. OS3113909 (FIGS. 4 and 5). However, such a structure can be used only if the energy loss heat source (or sources) can be disposed directly on or in the duct.

In a ring spinning machine, it has been known to cool a drive motor by means of the air flowing through a suction duct, the air being blown towards the drive motor after passing through a filter to retain entrained yarn residues. If the drive motor speed is controlled, not by a mechanical control mechanism which generates only little frictional heat, but by a frequency converter which generates a considerable amount of heat due to electrical energy losses, the frequency converter must also be cooled in order to dissipate its energy loss heat.

Accordingly, it is an object of the invention to reduce the heat evolution of textile machinery.

It is another object of the invention to improve the heat dissipation in textile machinery.

It is another object of the invention to provide for an increased protection of the individual components of a textile machine from fly.

It is another object of the invention to be able to reduce the motor dimensions for a textile machine.

It is another object of the invention to reduce the noise level of a textile machine during operation.

It is another object of the invention to dissipate the energy heat loss from a textile machine in a simple, efficient and space saving manner.

Briefly, the invention provides a method of dissipating heat from a room containing textile machines as well as an apparatus therefor.

In accordance with the method, a cooling fluid is circulated through at least one closed circuit in order to cool the heat-emitting parts of the textile machine while heating the cooling fluid. The heated cooling fluid is also passed in heat exchange relation with a flowing air stream in order to cool the fluid while heating the air stream. The heated air stream is then guided out of the machine and the room.

The apparatus used in accordance with the invention is employed with a textile machine having at least one heat-emitting part, for example, spindles, motors, invertors for determining the speed of rotation of the spindles and convertors for controlling the speed of a drive motor. The apparatus includes an air duct, means for passing an air stream through the duct and a cooling fluid circuit for circulating a cooling fluid in heat exchange relation with the heat-emitting part. In addition, the cooling circuit has a re-cooling stage disposed in the air duct for cooling of the cooling fluid in heat exchange with the air stream.

The use of a cooling fluid to cool the motors of the textile machine allows the operating temperature of the motors to be reduced so that the motors may be made smaller. Likewise, the motor power loss is reduced in a similar manner.

In addition, mechanical waste heat from heat-emitting parts such as spindles, with or without a motor, can be removed from the spinning plant or shop.

The cooling fluid circuit may use fluid carriers for coolant which are integrated with the heat-emitting parts of the textile machine so as to, at least, partially enclose these parts so that the parts have better protection against fly. The cooling fluid carriers may also act as silencers so that the noise of the machine is reduced.

When used in a ring spinning machine, no separate re-cooling system is required since such machines have suction air ducts which may be used for cooling of the cooling fluid.

The cooling fluid circuit is conducted so that the fluid cooling flow is independent of the motor speed and, hence, of any fan used on a rotor shaft.

In accordance with the invention, a ring spinning textile machine may be constructed with a support member, a plurality of invertors mounted on the support member for determining the speed of rotation of spindles, a horizontal suction air duct below the support member and a cooling fluid circuit having a fluid carrier extending through the support member for passing a cooling fluid in heat exchange relation with the invertors. This permits the invertors to be positioned at a user-friendly height and, at the same time, in a non-obstructive manner. It is also possible to extract heat from the invertors, particularly if the invertor parts are secured directly to the support member.

The heat-emitting parts of the textile machine may be provided by various elements. For example, an energy loss heat source may, more particularly, be formed by power elements or power modules (e.g., power semiconductors) in the machine drive power supply. The energy loss heat source may alternatively comprise a plurality of parts which emit heat due to energy losses, e.g., both a drive motor and its power supply. In such cases, preferably, the motor used has a built-in cooling system and is so connected to the circuit that the circuit cooling fluid flows through the motor cooling system.

The energy loss heat source may also comprise control elements, e.g., control electronics or control circuits.

The energy loss heat source may also be coupled to the cooling circuit directly or indirectly. If the heat source is indirectly coupled to the cooing circuit, an air flow can be utilized to transfer heat from the source to the circuit. Where the energy loss heat source contains parts which react sensitively to the state of their environment, the air flow may be treated prior to being utilized to transfer the energy loss heat, for example, semiconductors react sensitive to dust so that the transfer air should be filtered before passing the semiconductor. The energy loss heat source can also be separated from the spinning shop by a cabinet.

The energy loss heat source may alternatively be directly coupled to the cooling circuit. This means that the energy loss heat source is mounted either on a circuit part or in the immediate vicinity of a circuit part, or on a heat-transfer element or in the immediate vicinity of a heat-transfer element, the heat-transfer element (e.g., a fluid radiator) being in contact with a cooling circuit part.

The cooling circuit preferably includes a part which extends along the suction duct (in the longitudinal direction of the machine). This part of the circuit may have a length such that the heat to be dissipated is passed to the air in the suction duct during operation. This part preferably extends substantially over the entire length of the duct.

That part of the cooling circuit which gives up the energy loss heat to the suction air may be exposed directly to the suction air, e.g., the part may extend within the duct itself. Alternatively, the part may be separated from the air, which may possibly be carrying dust and fibers or yarn residues. For example, the part may be so disposed on the outer surface of the duct that the energy loss heat is transmitted to the air via the duct walls. In the latter case, the arrangement should be such that the thermal radiation from the circuit part in a direction away from the duct is kept sufficiently low. In one advantageous variant, a cooling conduit is integrated into the duct wall.

These and other objects and advantages will become more apparent from the following detailed description taken in conjunction with the accompanying drawings wherein:

FIG. 1 diagrammatically illustrates a ring spinning machine constructed in accordance with the invention;

FIG. 2 illustrates a cross-section through a spindle rail according to a first exemplified embodiment of the invention;

FIG. 3. illustrates a cross-section through a spindle rail with a second exemplified embodiment;

FIG. 4. illustrates a cross-section through a spindle rail with a third exemplified embodiment;

FIG. 5. illustrates a view partially in section of a spindle rail with a fourth and fifth exemplified embodiment;

FIG. 6. illustrates a cross-section through a spindle rail with a sixth exemplified embodiment;

Figure 9:
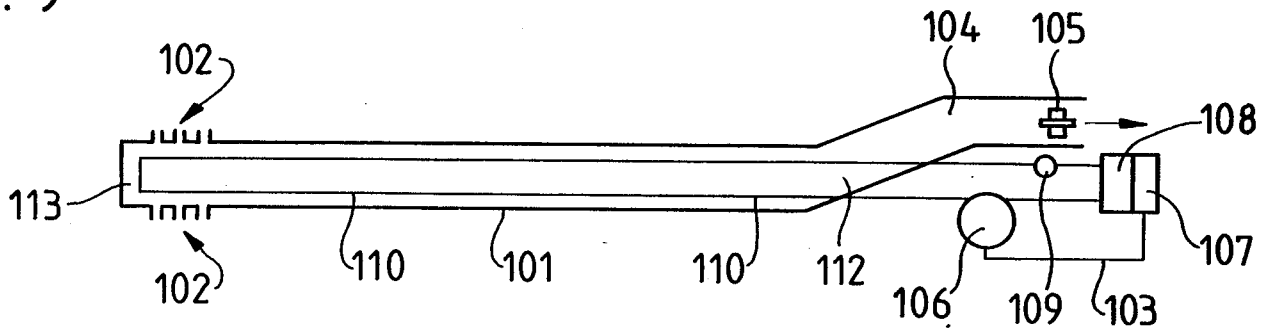
Figure 10:
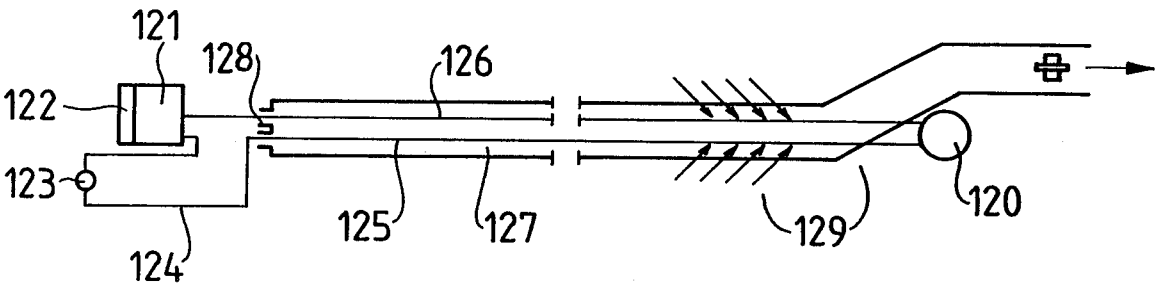
Figure 18:
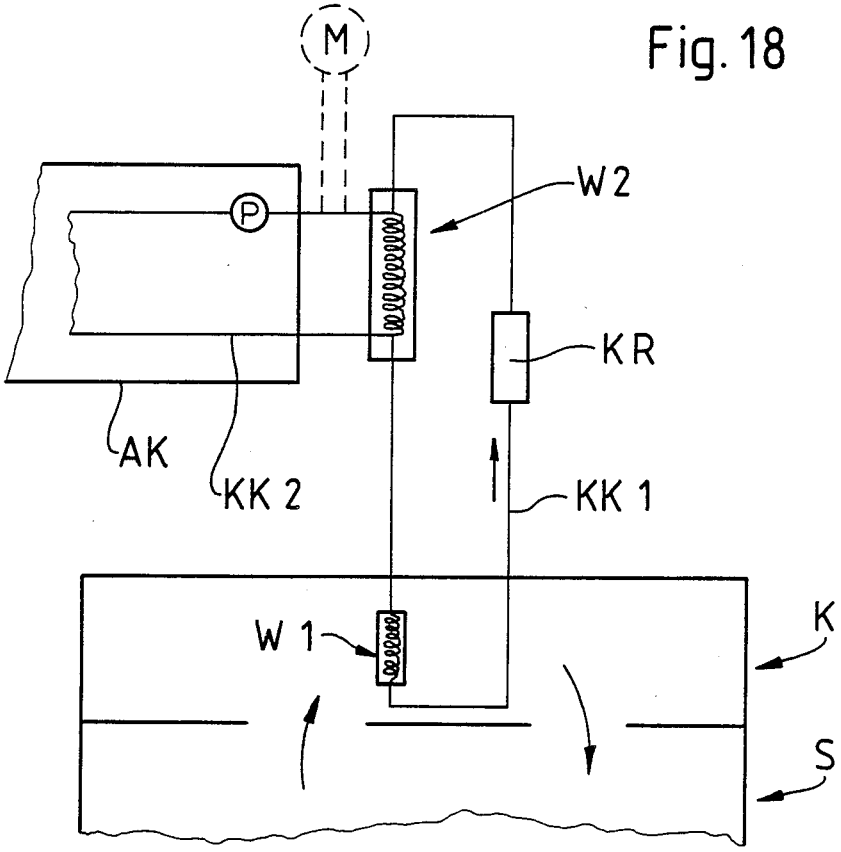
Figure 19:
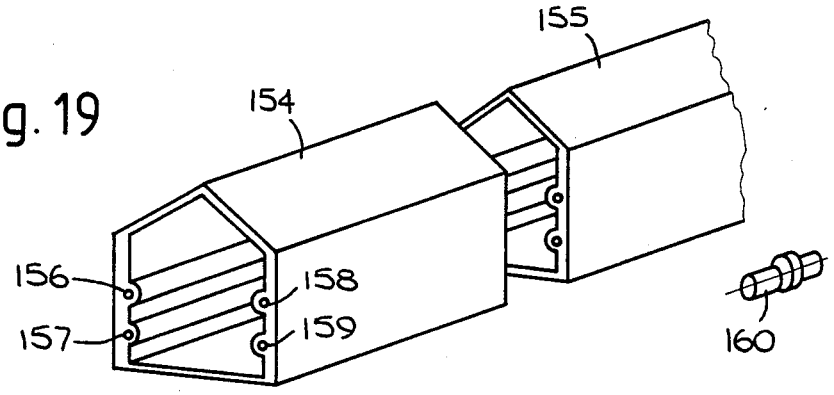

FIG. 9 diagrammatically illustrates a cooling system in a ring spinning machine according to the invention;

FIG. 10 illustrates a modified cooling system in comparison with FIG. 9;

FIG. 11 diagrammatically illustrates a cross-sectional view through a modified fly suction duct in accordance with the invention;

FIG. 12 shows a detail of FIG. 11 to an enlarged scale;

FIG. 13 illustrates a suction duct of sectional construction in accordance with the invention shown in perspective;

FIG. 14 illustrates a schematic arrangement of an apparatus in accordance with the invention;

FIG. 15 schematically illustrates an indirect heat transfer to a cooling circuit in accordance with the invention;

FIG. 16 illustrates a cooling duct with a clamped cooling loop with a clamping device situated in the cooling duct;

FIG. 17 shows the cooling loop of FIG. 16 with the clamping device outside the cooling duct;

FIG. 18 shows another variant of an indirect heat transfer to a cooling circuit in accordance with the invention;

FIG. 19 shows an extruded suction duct of sectional construction with integrated cooling conduits in accordance with the invention.

Referring to FIG. 1, the textile machine has an end head part 2 containing means, such as a fan 3 which draws air in from a suction air duct 4 communicating with drawing frame rolls (not shown) of the spinning stations and delivers the air in a stream 12 to atmosphere from the spinning shop via a filter 6 and through an outgoing air duct 7 and floor ducts 8.

A cooling fluid circuit is provided for circulating a cooling fluid in heat exchange relation with heat-emitting parts of the textile machine. As illustrated, the cooling circuit has a first pipe coil 9.1 disposed in the air stream 12 in the outgoing air duct 7 and is part of a cooing fluid carrier 10.1 which forms a closed circuit. The hot cooling fluid is thus re-cooled by the air stream and the first pipe coil 9.1 represents the re-cooling stage. If necessary, a circulating pump 11 can impart a flow to the cooling fluid, which is water in this case.

A cooling jacket 14 is disposed around an end head motor 13 which is a built-in motor, i.e., the built-in parts, the rotor and the stator, are mounted in a cylindrical motor cowling suitable for cooling purposes. The arrangement shown in FIG. 1 contains individually driven spindles 15 so that there is no need for a central spindle drive motor. The end head motor 13 may either be an auxiliary motor for the drawing frame drive or for a lifting movement or alternatively a sectional motor not accommodated in the end head.

Referring to FIG. 1, the textile machine has a spindle rail 17 having a plurality of spindles 15 mounted longitudinally therealong. In addition, a cooling fluid circuit is provided for circulating a cooling fluid in heat exchange relation with the spindles 15. This cooling circuit employs a cooling fluid carrier 10.2 which has a pipe coil 9.2 disposed within the outgoing air duct 7 for cooling of the heated cooling fluid. A second pipe coil 9.2.1 may be provided in the suction air duct 4 for additional cooling purposes.

The textile machine also has a support member 18 extending over and above the suction air duct 4 from which a plurality of invertors 19 are suspended for determining the speed of rotation of the spindles 15. A third cooling fluid circuit is also provided for cooling the invertors 19. This cooling circuit includes a fluid carrier 10.3 having a pipe coil 9.3 disposed in the outgoing air duct 7.

Referring to FIG. 2, each spindle 15 may cooperate with an individual spinning drive motor 25.1 which is adapted to drive the spindle 15 and which is mounted on a horizontal limb 26 of the rail 17 via a bearing 36. In addition, each spindle 15 is provided with a downwardly extending housing 27 which is pivotal about a vertical axis and which passes into a cooling fluid carrier 10.2 integral with the rail 17. As indicated, an elastic rubber base 29 is disposed below the motor 25.1 while the spindle housing 27 extends into a chamber 30 of the fluid carrier 10.2 so as to be in direct contact with the cooling fluid flowing therethrough. The housing 27 is also mounted in the fluid carrier 10.2 in an elastically releasable manner by means of a flexible lip seal 31. This seal 31, on the one hand, prevents water which may be at a low pressure of about 30 millimeters of water column from escaping while, on the other hand, ensuring pivotability of the spindle housing 27 about the vertical axis.

As indicated, the fluid carrier 10.2 is integrally molded with the spindle rail 17, for example, by extrusion.

In the illustrated construction, the heat due to frictional losses in the bottom zone of the spindle housing 27 can be transmitted directly to the cooling water. The heat due to mechanical and electrical energy losses is fed to the bottom zone of the spindle housing 27 by heat conduction. Thus, the motor 25.1 is also cooled.

In this embodiment, the cooling water is fed in one direction on one longitudinal side of the machine and in the opposite direction on the other longitudinal side of the machine. In this case, the two spindle rails 17 may be connected by a metal or plastic flexible tube. Obviously, flexible tubes or intermediate elements are required in the case of a vertically movable spindle rail 17.

Calculations (see also Widermann/Kernenberger-Konstruktion elektrischer Maschinen, 1967) have shown that considerable quantities of heat (10 W per spinning station) can be dissipated even with a 10° C. temperature difference between the hot cooling water (40° C.) and the cooled cooling water (30° C.) and that in most cases the amount of air normally drawn in is sufficient for the re-cooling. The conventional air cooling capacity of the fans converted to about 1.4 watts per spinning station (Widermann equation 278, page 550) is also absent. The delivery power of the circulating pump 11 for the water circuit with a flow of 2.4 liters per second and a pipe diameter of 25 mm including losses due to deflection is in the region of 0.3 watt (Wiedermann, page 68). For a spinning machine with 1000 spindles, there is an energy saving of about 1 kW.

Figure 3:
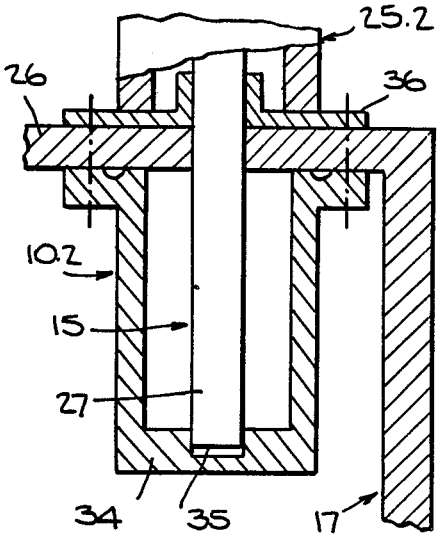

Referring to FIG. 3, wherein like reference characters indicate like parts as above, the drive motor 25.2 has no elastic base 29, because the spindle housing 27 itself is not constructed to be pivotable (deflections of the spindle blade take place in the spindle housing 27). An elongate trough 34 is bolted as part of the cooling fluid carrier 10.2 to the bottom of the limb 26 in water-tight relationship, a blind hole 35 being drilled for each spinning station. The spindle housing 27 is thus positioned in its exact position at its bottom end. The vibrations of the spindle 15 can thus be absorbed more satisfactorily, thus also reducing the textile machine noise. The heat transfer or heat conduction to the spindle housing 27 from the heat-emitting part in the form of the drive motor 25.2 is better here due to the absence of the rubber base 29. The bottom bearing plate 36 of the motor 25.2 is locally enlarged radially for the purpose of fixing to the spindle rail 17.

Figure 4:
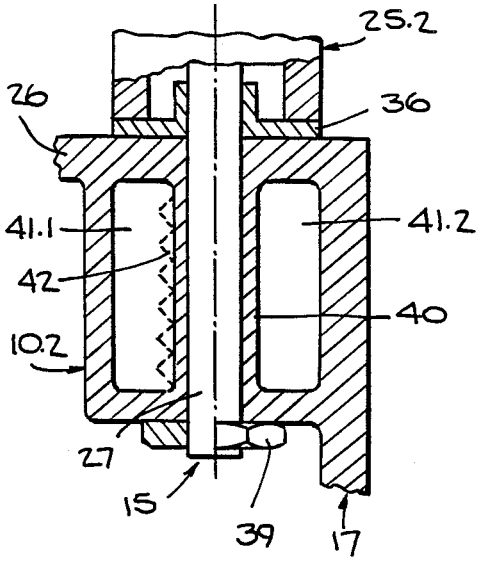

Referring to FIG. 4, wherein like reference characters indicate like parts as above, the spindle housing 27 may extend through the cooling fluid carrier 10.2 integrally connected to the spindle rail 1 and be externally releasably fixed at a bottom end by a screwed-on ring 39 or a nut. The spindle housing 27 does not touch the cooling water directly, but is separated from the water by a wall 40 in a traversing zone. This traversing wall is part of the extrusion 17, 10.2 and is thus continuous, so that two separate parallel fluid ducts 41.1, 41.2 are formed which form a supply and discharge duct on one side of the machine so that the cooling fluid is in indirect contact with the spindle housing 27. In order to eliminate air gaps between the spindle housing 27 and the wall 40 and hence poor heat transfer, a thermally conductive paste is provided. The wall 40 may have finned surface 42 for the purpose of better heat transfer.

Figure 5:
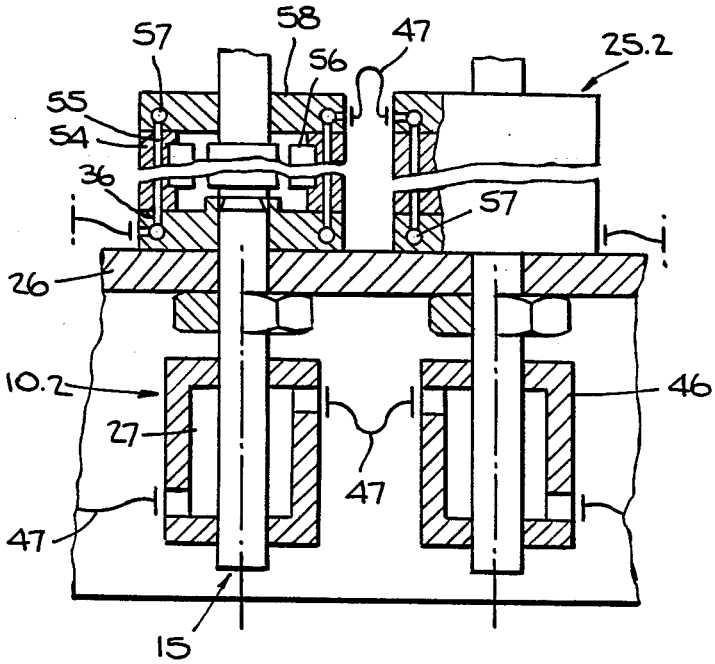

As shown in FIG. 5, the cooling fluid carrier 10.2 may have subcarriers 46 individually releasably connected to each spindle housing 27 by means of Seeger rings or the like. The individual subcarriers 46 are interconnected by flexible hose, tubes or ducts 47. Although a motor 25.2 is used in this case, it is also possible to fit a motor type 25.1, since the spindle housings 27 can be pivotally mounted.

Figure 6:
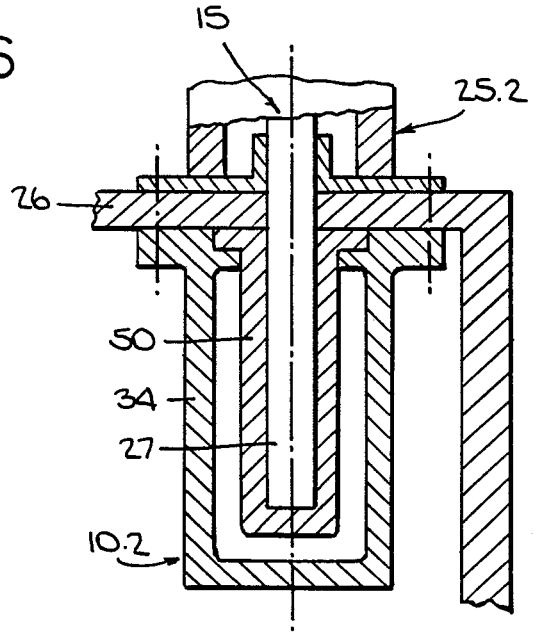

Referring to FIG. 6, the cooling fluid circuit may include an insert 50 enclosing a spindle housing 27 (with thermally conductive paste) as well as a trough 34 which is closed by the insert 50 at the top in water-tight relationship. The motor 25.2 together with the spindle housing 27 can thus be replaced without any additional action being required, e.g., reduction of water pressure. An additional advantage is that the elongate trough 34 can itself be made with sufficient strength (preferably as an aluminum extrusion) while the inserts 50 can be made thin. Deep-drawn thin copper inserts 50 may be advantageous.

FIG. 5 also shows a construction in which the motors 25.2 can themselves be directly cooled. This can be reliably effected if lamination carriers 54 or stator retaining elements have vertical cooling water ducts 55 which do not touch the laminations 56 and which communicate with round ducts 57 in the bottom bearing plate 35 (shown to a somewhat enlarged scale) and top bearing plate 58 which are spaced by the retaining elements 54. Here too, flexible hoses 47 are provided between the motors 25.2 to connect the ducts 57. All the motors 25.2 are, in this case, connected in series in terms of cooling but other circuits are possible, e.g., a parallel circuit or a sectional series circuit.

Figure 8:
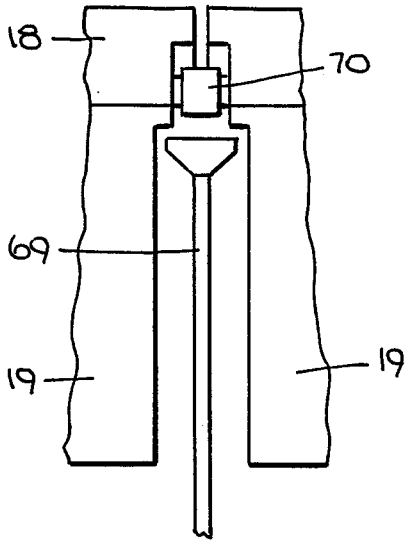
FIG. 8 is a partial side elevation of the invertor box shown in FIG. 7.
Figure 7:
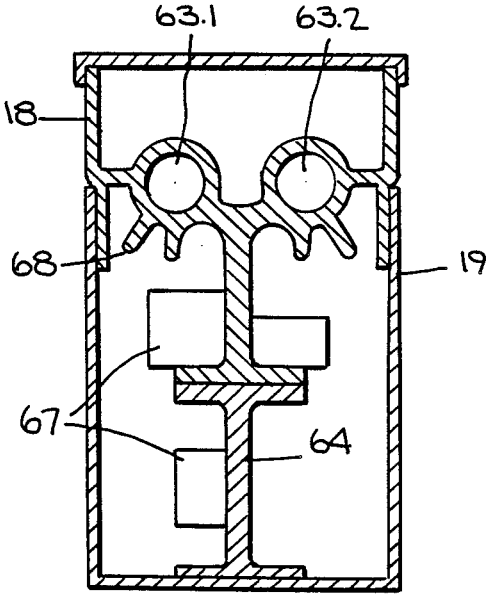
FIG. 7 illustrates a cross-section through an invertor box employing a cooling circuit in accordance with the invention.

Referring to FIGS. 7 and 8, the invertors 19 are suspended from the support member 18 which is made of extruded aluminum and comprises two cooling water ducts 63.1, 63.2. In this case, an I-shaped member 64 is provided between the support member 18 and the bottom plate of the invertor 19 in order to support the same. Heat-emitting invertor parts 67 can be fixed directly on the cooled metal parts 18, 64 so that they can be cooled by thermal conduction. In order that the air in the invertor 19 may also be additionally coolable, fins 68 are provided on the ducts 63.1, 63.2. Electric wiring can be placed in the space above the cooling water ducts 63. If receiving rods 69 (FIG. 8) are located in the central plane of the machine, they can be shortened to serve as carrier elements for the invertors 19 and the support member 18. The cooling water connection between the component parts of the support member 18 can be provided by pipe joints 70, the ends of the cooling water ducts 63 being made cylindrical by removal of the fins 68.

Clearly, other advantageous embodiments are possible by combinations of the examples illustrated.

Referring to FIG. 14, VQ denotes a source of heat due to energy losses, e.g., a drive motor and/or its energy supply, KKL denotes a coolant circuit and AK a suction duct, e.g., the fly suction duct of a ring spinning machine. The circuit KKL is preferably a fluid circuit, e.g., a water circuit. A circulating means (not shown), e.g., a pump, can maintain circulation of the coolant in operation.

The circuit KKL is so connected to the energy loss heat source that the energy loss heat to be dissipated is transferred from the source to the coolant. Various possibilities for this purpose will be explained with reference to the other Figures.

The circuit KKL is also so connected to the suction duct that the heat absorbed by the coolant is largely given up to the air in the duct. Various possibilities are also explained in this case with reference to the other Figures. However, FIG. 17 also shows an advantageous feature, i.e., the arrangement of a part of the cooling circuit with a configuration extending in the longitudinal direction of the air duct.

A number of variants of this principle will now be explained with reference to the other FIGS. 9 to 13 and 15 to 18.

FIG. 9 shows a central fly suction duct 101 extending in the longitudinal direction of a ring spinning machine now shown in detail. A fly suction tube 102 is connected to the suction duct 101 at each spinning station and discharges beneath the drawing frame in front of the exiting spun yarn. At the drive head 103 of the machine, the suction duct 101 is provided with a bend portion 104 containing a fan 105 which maintains a stream of suction air through the suction tubes 102 and the suction duct 101. The common drive motor 106 for the spindle stations is situated beneath the bend in a drive box.

The drive motor 106 is connected to the power supply via a converter, e.g., a frequency converter 107. The speed of the drive motor 106 and hence the speed of the spindles (not shown) are controlled in infinitely variable manner by means of the frequency converter 107. The frequency converter 107 is fixed on a cooling block 108 (e.g., a "fluid radiator"), to transfer heat thereto due to energy losses.

The cooling block 108 and a circulating pump 109 are interconnected by a cooling conduit 110 to form a closed cooling circuit. The cooling conduit 110 extends in the form of a loop 111 axially through the suction duct 101, from one end 112 to the other end 113. Thus, the suction air which flows through the duct 101 flows entirely around the cooling fluid conduit 110. The coolant in the cooling conduit 110 is water which is circulated in the circuit by the circulating pump 109, thus absorbing the energy loss heat of the cooling block 108 and transferring the heat to the suction air discharged by the fan 105. The cooling capacity of the cooling circuit is proportional to the length of the suction duct 101 or to the length of the machine and hence proportional to the drive power thereof. Instead of water, a different coolant, e.g., air or fluid known from cooling technology, may be used.

The motor 106 can also be in the form of a fluid-cooled motor and the motor cooling system can also be integrated into the cooling conduit 110.

The loop 111 of the cooling conduit 110 may lie on the floor of the suction duct 101 or may be clamped between the two ends 112 and 113 of the suction duct as shown in FIGS. 16 and 17 by means of a clamping element a disposed at the end wall b of the suction duct, so the loop 111 spans the length of the suction duct uncovered. For this purpose, the loop 111 would be made from a lightweight material, e.g., a plastics material, for example, polyethylene, which has a very smooth surface, so that fly deposits thereon are greatly reduced. The end of the loop may also be passed through two bores c, d, in the end wall e of the suction duct and provide a clamping element f between the end wall and the loop.

Although only one drive motor is referenced, a plurality may be provided as is the case in a ring spinning machine with a sectional drive. The motors are then in series in the cooling circuit and have cooling water flowing through them successively. If each motor is allocated its own frequency converter, the same applies thereto. It should also be noted that there is no need for the drive motor and the frequency converter both to be accommodated in the cooling circuit. It is possible to cool just the drive motor. The frequency converter can in such cases cool down naturally or be cooled in its own cooling circuit similar to the drive motor cooling circuit.

In the exemplified embodiment shown in FIG. 10, a drive motor 120 and a frequency converter 122 are disposed separately, e.g., at opposite ends of the machine. The drive motor 120, a cooling block 121 of the frequency converter 122 and a circulating pump 123 are interconnected by a cooling conduit 124 and again form a closed cooling circuit. From the cooling conduit 124, two lines 125, 126 extend axially through a suction duct 127. The lines 125, 126 extend through the end walls 128, 129 of the suction duct and may be fixed in the end walls by clamping nuts so that they do not sag.

Since the overall length of the suction duct 127 is considerable, the part of the cooling conduit mounted therein is also long and therefore offers a relatively large surface for the deposition of fly. In this connection, in the exemplified embodiment shown in FIG. 11, the cooling conduit 142 is situated outside the suction duct 135. The suction duct 135 is provided with rectangular shoulders 139, 140 respectively in the two corners 137, 138 in the bottom zone 136. Rectangular cooling conduits 141, 142 respectively rest on each shoulder and each forms one line of a closed cooling circuit for the drive motor, the frequency converter and the circulating pump. In order to reduce the resistance to heat transfer between the lines and the suction duct, a layer 143 of a good thermally conductive material, e.g., a thermally conductive paste or a copper foil, is provided between the two as shown by the enlarged detail in FIG. 12. This layer compensates for any irregularities in the two contacting surfaces.

FIG. 13 shows the construction in the case of a suction duct 146 composed of a plurality of sections 147, 148, 149 as is generally the case in a ring spinning machine. Each section is in each case provided with a cooling conduit in a corner over its length, e.g., section 147 is provided with cooling conduits 150, 151 which are closed at two ends. The cooling conduits of each section are connected to the cooling conduits of the next section by bridging elements, such as elbows of the same flow cross-section. For example, elbow 152 bridges cooing conduit 151 of section 147 with the cooling conduit 153 of the next section 148.

FIG. 15 shows the energy loss heat source VQ (see also FIG. 14) in a cabinet S divided into a top and bottom chamber by a partition TW. The partition TW has openings, A, B to allow air circulation between the chambers. This can be a forced flow produced by a fan. The energy loss source VQ is disposed in the bottom chamber and a fluid radiator FK in the top chamber. Radiator FK transfers heat from the air flow to the coolant in the circuit KKL. The energy lost source may comprise both the power semiconductors and the control semiconductors for the drive motor. The cabinet S separates these parts of the electronics from the dust air of the surroundings, e.g., the spinning shop.

No exchange of air may take place between the interior of the cabinet and the spinning shop.

This aspect of the invention can also be used in conjunction with other textile machines having a longitudinal direction (longitudinal component machines) if such machines also have a suction duct extending in the longitudinal direction. Examples of longitudinal component machines are rotor spinning machines, false-twist texturizing machines, winders, false-twist spinning machines, flyers and combing machines.

FIG. 18 shows another variant of the principle. It will be assumed that a switchbox S contains just control electronics, so that the temperature in the box S will not become very high (e.g., 40° C.), but that the heat due to the energy losses must be dissipated. The box S may be provided with a chamber K and the air from the box S can be circulated through this chamber K (see arrows). Chamber K contains an air/fluid heat-exchanger W1, the heat being discharged via a fluid cooling circuit KK at a somewhat lower temperature than the "box temperature".

The cooling circuit KK comprises a compressor KR which compresses the fluid and in so doing raises the temperature to a relatively high value (e.g., 120° C.). The hot fluid then flows through fluid/fluid heat exchanger W2, which transfers heat to the fluid in the second fluid cooling circuit KK2 containing a pump p. This cooling circuit KK2 extends along the suction duct AK as already described above. By raising the temperature of the fluid in the cooling circuit KK1, it is possible to substantially increase the efficiency of the transfer in the heat exchanger W2.

A drive motor M having a corresponding cooling system can be connected to the cooling circuit KK2.

FIG. 19 shows a variant of the embodiments according to FIGS. 11 to 13. The suction duct is made up of extruded sections 154, 155, for example, formed from aluminum. Cooling conduits 156, 157, 158, 159 for forming the cooling circuit (KKL, FIG. 14) are integrated in the wall of the duct, i.e., they are formed in the extrusion process itself. The conduit parts of adjacent sections can be connected by sealing sleeves (e.g, sleeve 160). FIG. 19 shows the cooling conduits in the form of beads projecting into the interior of the duct, i.e., the duct is externally smooth. The beads could, however, extend outwardly from the outer wall, i.e., the duct may be smooth on the inside. Of course, the beads may project inwardly and outwardly from the wall surface, in which case there is no difficulty in integrating a plurality of cooling conduits in the duct wall.

It will be clear that the heat due to energy losses is not simply passed to the air in the suction duct but is carried out of the spinning shop along with the heat dissipated from the heat-emitting parts of the machine, such as the spindles, and drive motors.

The invention thus provides a relatively simple technique for dissipating the heat generated in a textile machine, such as a ring spinning machine. Further, the dissipated heat can be conducted out of the textile machine as well as out of the room containing a plurality of such textile machines so that the need for a separate air conditioning plant is not required.

The invention also provides a heat dissipating system which employs a suction air duct for fly as a source of the heat carrying medium for removing heat from within a textile machine.

What is claimed is:

1. A method of dissipating heat from a room containing textile machines, said method comprising the steps of drawing an air stream under suction through a textile machine to remove dust and fly from the textile machine;

circulating a cooling fluid through at least one closed circuit to cool heat-emitting parts of the textile machine while heating the cooling fluid;

passing the heated cooling fluid in heat exchange relation with said air stream to cool the cooling liquid while heating said air stream; and guiding the heated air stream out of the room.

2. A method as set forth in claim 1 wherein the cooling fluid is circulated through a closed path in a heat-emitting machine part of at least one textile machine to absorb heat therefrom.

3. In combination a textile machine having at least one heat-emitting part and an air duct;

means for drawing an air stream through said textile machine to remove dust and fly therefrom and passing said air stream through said duct; and a cooling fluid circuit for circulating a cooling fluid in heat exchange relation with said heat-emitting part, said circuit having a re-cooling stage disposed in said duct for cooling of the cooling fluid in heat exchange with said air stream.

4. The combination as set forth in claim 3 wherein said means is a fan for blowing the air stream through said duct.

5. The combination as set forth in claim 3 wherein said heat-emitting part is a spindle housing.

6. The combination as set forth in claim 5 wherein said cooling fluid circuit passes the cooling fluid in direct contact with said spindle housing.

7. The combination as set forth in claim 5 wherein said cooling fluid circuit includes a fluid carrier receiving said spindle housing and having a pair of parallel fluid ducts for passing the cooling fluid in indirect contact with said spindle housing.

8. The combination as set forth in claim 5 wherein said textile machine includes a spindle rail having said spindle housing mounted thereon and said cooling fluid circuit includes a fluid carrier integrally formed with said rail for passing the cooling fluid therethrough.

9. The combination as set forth in claim 8 which further includes means for mounting said spindle housing in said fluid carrier in elastically releasable manner.

10. The combination as set forth in claim 8 wherein said spindle housing is mounted at a lower end in said fluid carrier.

11. The combination as set forth in claim 5 wherein said cooling fluid circuit includes an insert enclosing said spindle housing and passes the cooling fluid into contact with said insert.

12. The combination as set forth in claim 3 wherein said textile machine includes a plurality of said parts, each said part comprising a spindle housing and said cooling fluid circuit includes a plurality of sub-carriers for conveying the cooling fluid therethrough, each said sub-carrier having a respective spindle housing mounted therein for passing of the cooling fluid in heat exchange therewith.

13. The combination as set forth in claim 3 wherein said textile machine includes a plurality of said parts, each said part including a spindle drive motor having a pair of bearing plates and a pair of stator retaining elements spacing said bearing plates apart; and wherein said cooling circuit includes cooling ducts in said bearing plates, cooling ducts in said retaining elements connected to said ducts of said plates and flexible ducts connected to said ducts in said retaining elements to flexible ducts of adjacent drive motors.

14. A ring spinning textile machine comprising a support member;

a plurality of inverters mounted on support member for determining the speed of rotation of spindles;

a horizontal suction air duct below said support member; and a cooling fluid circuit having a fluid carrier extending through said support member for passing a cooling fluid in heat exchange relation with said inverters.

15. A ring spinning textile machine as set forth in claim 14 further comprising a second air duct communicating with said suction air duct to receive an air flow therefrom and said cooling fluid circuit having a recooling stage disposal in said second air duct.

16. A ring spinning machine comprising a longitudinally extending fly suction duct for conveying a flow of air therethrough to remove fly from the machine;

a spindle drive motor;

a converter for controlling the speed of said motor; and a cooling fluid circuit for circulating a cooling fluid in heat exchange relations with said motor and said convertor, said circuit having a conduit extending in heat exchange relation within said duct for heat exchange with the flow of air therein.

17. A machine as set forth in claim 16 wherein said circuit includes a circulating pump for circulating coolant through said conduit.

18. A machine as set forth in claim 17 wherein said motor and said convertor are disposed at a common end of said duct, said pump is disposed at an opposite end of said duct and said circuit has a pair of parallel lines passing through said duct.

19. A machine as set forth in claim 16 wherein said motor and convertor are disposed at a common end of said duct and said conduit forms a loop in said duct.

20. A machine as set forth in claim 16 wherein said conduit extends along an exterior of said duct.

21. A machine as set forth in claim 20 wherein said duct has a pair of shoulders in a floor thereof and said conduit has a line contained in each respective shoulder.

22. A machine as set forth in claim 21 wherein said duct comprises a plurality of interconnected longitudinally disposed sections and said conduit includes bridging elements interconnecting said lines of said sections.

23. A machine as set forth in claim 20 which further comprises a heat-transfer layer between said duct and said conduit.

* * * * *

UNITED STATES PATENT AND TRADEMARK OFFICE

CERTIFICATE OF CORRECTION

PATENT NO. : 4,976,098

DATED : December 11, 1990

INVENTOR(S) : URS MEYER, et al

It is certified that error appears in the above-identified patent and that said Letters Patent is hereby corrected as shown below:

Column 1, line 40 change "o" to -on-
Column 6, line 20 change "l" to -17-
Column 9, line 57 change "p." to -P.-
Column 10, line 41 change "liquid" to -fluid-

Signed and Sealed this

Seventh Day of July, 1992

*Attest:*

DOUGLAS B. COMER

*Attesting Officer*

*Acting Commissioner of Patents and Trademarks*